United States Patent [19]

Weiser et al.

[11] Patent Number: 4,517,537

[45] Date of Patent: May 14, 1985

[54] ELECTROMAGNETIC MINIATURE RELAY AND METHOD OF MANUFACTURE

[75] Inventors: Josef Weiser, Hohenschaftlarn; Alfred Heinzl; Heinz Stadler, both of Munich, all of Fed. Rep. of Germany

[73] Assignee: Siemens Aktiengesellschaft, Berlin and Munich, Fed. Rep. of Germany

[21] Appl. No.: 609,305

[22] Filed: May 11, 1984

[30] Foreign Application Priority Data

May 20, 1983 [DE] Fed. Rep. of Germany ..... 3318493

[51] Int. Cl.[3] ..... H01H 3/00

[52] U.S. Cl. ..... 335/187; 335/203; 29/622

[58] Field of Search ..... 335/121, 124, 126, 131, 335/133, 187, 203

[56] References Cited

U.S. PATENT DOCUMENTS

| | | | |
|---|---|---|---|
| 2,510,157 | 6/1950 | Towner et al. | 335/203 |
| 3,418,608 | 12/1968 | Angel et al. | 335/131 |
| 3,708,768 | 1/1973 | Pratt | 335/203 X |
| 3,717,829 | 2/1973 | Flaherty | 335/187 |
| 4,045,752 | 8/1977 | Frigo | 335/203 X |

FOREIGN PATENT DOCUMENTS

| | | | |
|---|---|---|---|
| 977014 | 12/1973 | Canada | 335/187 |
| 1816364 | 7/1970 | Fed. Rep. of Germany | 335/187 |
| 2537462 | 3/1976 | Fed. Rep. of Germany | 335/187 |

*Primary Examiner*—George Harris

*Attorney, Agent, or Firm*—Hill, Van Santen, Steadman & Simpson

[57] ABSTRACT

An electromagnetic miniature relay of a narrow structure characterized by a flat core being embedded in a body and extending outside of the ends of the coil to form pole pieces, a stationary contact element being embedded in the body adjacent each of the pole pieces, a flat armature extending parallel to the flat coil and having ends forming air gaps with the pole pieces, said armature carrying flat spring-like contact portions secured to the center of the armature and engaging the stationary contacts when the coil is energized to attract the armature into contact with the pole pieces.

11 Claims, 3 Drawing Figures

ELECTROMAGNETIC MINIATURE RELAY AND METHOD OF MANUFACTURE

BACKGROUND OF THE INVENTION

The present invention is directed to an electromagnetic miniature relay comprising a flat core disposed within an excitation coil with the ends of the core merging from the ends of the coil to form pole pieces for an armature which is positioned next to the coil and presses against the pole pieces upon energizing of the coil so that a contact arrangement including contacts carried by the armature and stationary circuits which are mounted adjacent the core are interconnected by the movement of the armature. The invention is also directed to a method of making such a relay.

Magnetic relays having the fundamental structure of a flat core received in a coil and having an armature positioned and biased away from pole pieces by a spring arrangement so that electrical contact is made between stationary and movable contacts have been known for a long time. These traditional, so-called flat relays have an armature which is seated at one side and when actuated sets the contact springs attached laterally to the relay over an actuation slide. This traditional structure with separately applied sets of contact springs is not suitable however for miniaturization.

SUMMARY OF THE INVENTION

The present invention is directed to providing a particularly simple miniature relay having the initially cited basic structure which can be manufactured with few and simple parts. In terms of structure or size and terminal configuration, the relay should be matchable to integrated circuit assemblies and should be able to be switched to handle relatively high currents despite its minimum overall size.

To accomplish these goals, the present invention is directed to an improvement in an electromagnetic miniature relay having a base body containing a flat core being disposed inside an excitation coil with ends of the core and the body extending from both ends of the coil to form a pole piece at each end of the coil for an armature which is disposed next to the coil and presses against both pole pieces when the coil is energized. The improvements are that at least one stationary contact with a terminal pin is anchored in the base body adjacent each end of the coil and in the area of the armature ends and a contact spring being connected to the central portion of the armature and having contact portions, the contact portions having a length along the length of the armature to extend beyond the ends of the armature to overlie the stationary contacts so that when the coil is energized, the armature moves against the spring portions and into contact with the pole pieces and the ends of the contact portion engage the two stationary contacts to form an electrical contact therebetween.

Since the core is stamped from a thin piece of sheet metal, the armature consists of a flat sheet and the contact arrangement can be a flat contact spring, the relay allows a very flat and respectively narrow profile because the total thickness of the relay includes the adding-up of the various thicknesses of the flat contact spring, the armature and the thickness of the sheet metal core disposed in a flat coil or winding. The stationary contact elements, which are positioned adjacent the ends and outside of the ends of the armature, do not increase the depth of the relay structure particularly when only two stationary contact elements for making contact or for breaking contact are provided. In such a case, it is also possible in a particularly simple fashion to allow the two terminal pins of the stationary contact elements to emerge from the relay to be aligned in one row with two coil terminal pins which are likewise anchored in the base body so that the relay can either be employed on an edge with a very narrow structure of a printed circuit board or flat with a very low structure and profile on a printed circuit board with the terminal pins extending in a row which has been bent at 90° on a common axis.

In one embodiment of the relay, the armature can be seated on one pole surface or piece and merely form a working air gap with a second pole surface or piece of the core. It is expedient in this case that the contact spring secured to the armature is also rigidly connected at one end to one of the stationary contact elements and enters into a switching condition with the other stationary contact element only at its other free end.

A particularly advantageous embodiment of the invention consists when the armature forms respectively working air gaps with both pole pieces of the core and thus executes a translational switch motion in a direction perpendicular to the coil axis. Therefore, the contact springs secured to the armature execute a switch motion with each of the two ends relative to the cooperating contact elements and form a bridge contact spring. It is thereby possible to switch relatively strong currents even given a very small structure and relatively slight armature stroke due to the double contact breaking with the bridge contact spring and due to the disposition of the interrelated, stationary contact elements at opposite ends of the relay with the insulating path of the corresponding length. A neutral or open position for the armature is expediently produced by means of a reset spring designed as a leaf-spring which like the contact springs rests flat against the armature and has a free end pressing against a seating surface on the base body. It is also expedient in order to guarantee a symmetrical force distribution to have the respective reset springs be provided at both sides of the contact spring. It is a particularly simple development to have the reset spring and contact springs joined as one piece in their center section and thus be formed of a single sheet of metal which has longitudinally extending cuts or slots to form the various spring portions. In the neutral or open position, the armature is expediently supported or urged against the housing cap by the force of the reset springs.

The base body expediently and simultaneously serves both as a coil body as well as a carrier for the stationary contact elements and under given conditions for coil connection elements. The core and the stationary contact elements can thereby be embedded in the base body so that only the pole pieces and the contact surfaces of the stationary contact elements are exposed.

It is expedient in forming the relay to provide the flat core and stationary contacts, embed the core and stationary contacts in the base body, assemble a coil on the body, provide an armature provide a spring contact arrangement with spring portions and contact portions, assemble the contact arrangement on the armature, position the armature with the spring portions engaging the body to form an assembly and then assemble a protective cap on the assembly to maintain the armature in its position.

It is particularly advantageous when the core and the cooperating contact elements are first stamped from a single blank and are interconnected by a respective holding web or guide strip. After this blank has been embedded in the insulating material forming the base body, the stationary contacts and the core can be subsequently separated from the guide strip. The coil terminal pins can also be stamped from the common blank and be co-embedded at the same time as the core and stationary contact elements. Again, after the step of embedding, they can be separated from the common holding web. After the core has been wound onto the body and the leads attached to the coil terminal pins, they can be bent to the desired final position.

DESCRIPTION OF THE PREFERRED EMBODIMENTS

Figure 1:
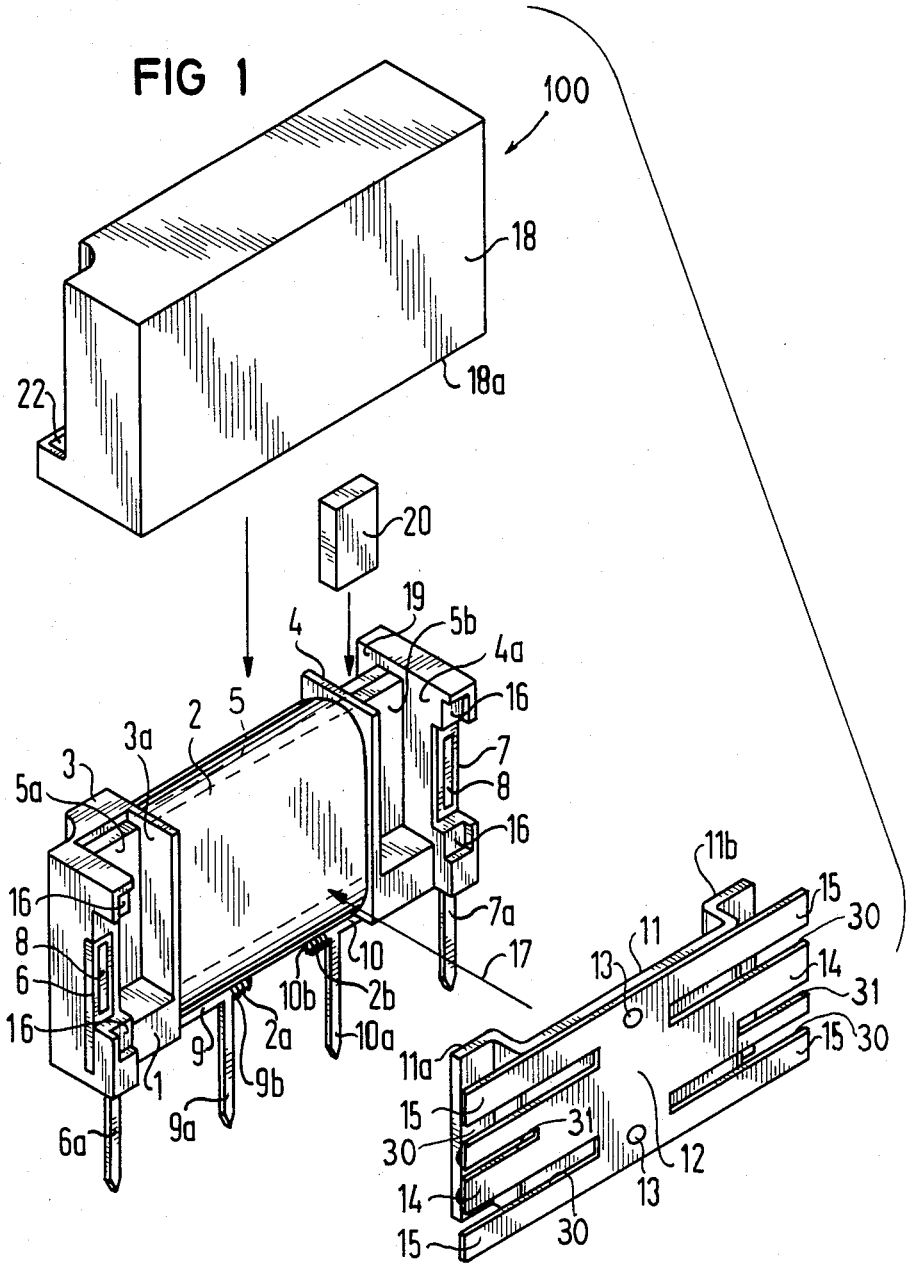
FIG. 1 is an exploded isometric view of a relay in accordance with the present invention.
Figure 2:
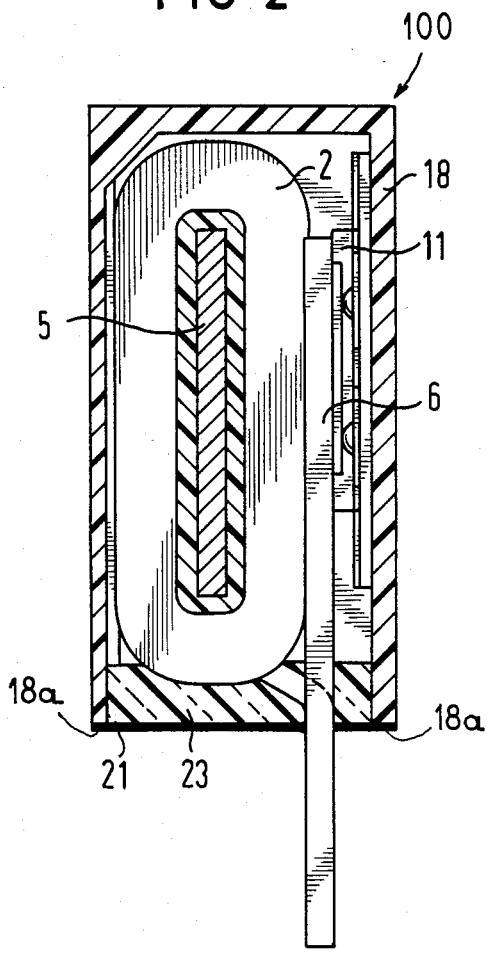
FIG. 2 is a cross-sectional view of the relay of FIG. 1 with portions in elevation to show various lateral positions of the parts.
Figure 3:
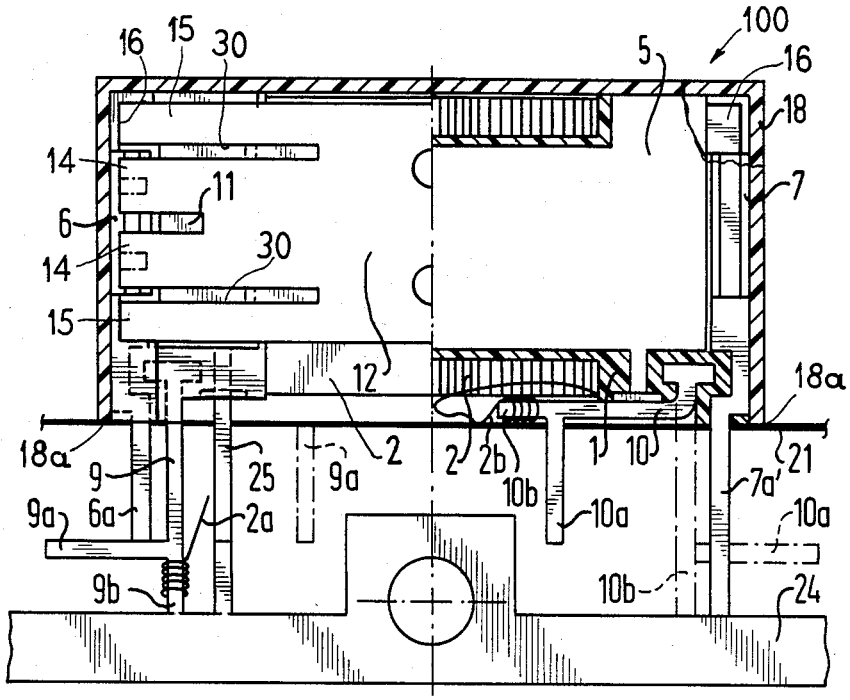
FIG. 3 is a longitudinal cross-section taken at different levels of the relay of the present invention.

The principles of the present invention are particularly useful when incorporated in a relay generally indicated at 100 in FIGS. 1, 2 and 3. The relay 100 consists of a base body 1, which serves both as a coil carrier as well as a contact carrier. In the center part, the body 1 carries a winding or coil 2, which is limited at both ends by flanges 3 and 4 which, as best illustrated in FIG. 1, have recesses 3*a* and 4*a* which are chamber-like. A flat core 5 is embedded in the base body 1 and extends through the core winding with the ends of the flat core extending beyond the ends of the coil and forming respective pole surfaces or pieces 5*a* and 5*b* in the recesses or chambers 3*a* and 4*a* respectively. The flanges 3 and 4 which are formed in the base body 1 also carry cooperating contact elements 6 and 7, respectively, at the end faces and in front of the pole pieces 5*a* and 5*b*. The contact elements 6 and 7 are embedded in the base body and have downwardly projecting connection pins or splines 6*a* and 7*a*, respectively. The contact elements 6 and 7 are respectively provided with contact surfaces 8. Along the lower edge from which the connection terminals or splines 6*a* and 7*a* extend, the base body 1 also carries two coil connection elements 9 and 10 which have downwardly projecting connection splines or terminals 9*a* and 10*a*, respectively. As illustrated, the pins 6*a*, 7*a*, 9*a* and 10*a* all extend in a single row. The connecting elements 9 and 10 also have winding support points 9*b* and 10*b* on which ends 2*a* and 2*b* of the winding or coil 2 are wrapped.

An armature 11, which is formed of a flat plate or sheet just as the core 5, has a pair of ends 11*a* and 11*b* which are bent to be offset from the plane of the armature. Thus, the end 11*a* can engage the pole piece 5*a* while the end 11*b* engages the pole piece 5*b* when the armature is attracted by the magnetic force created by energizing the winding 2. On a surface of the armature facing away from the coil 2, the armature 11 carries a sheet 12, which forms combined contact and reset springs. The sheet 12 is secured to the central part of the armature 11 by welds 13 or in some other manner. The sheet 12 at each end has a pair of slots 30 to subdivide the end into a contact portion 14 and two spring portions 15. In addition, the contact portion 14 is provided with a slot 31 to subdivide it for the purpose of double contacting. Thus, when the armature is pulled into engagement with the pole pieces due to actuation of the winding 2, the contacts 14 engage the contact surfaces 8 of the stationary contacts 6 and 7 to form a bridging contact interconnected to the stationary contact elements. The outer spring ends or portions 15 serve as reset springs which are respectively supported against seating surfaces 16 which are formed in the base body 1 adjacent to the recesses 3*a* and 4*a* and adjacent the contact elements or surfaces 8.

To assemble the armature 11 on the body 1, it is moved in the direction of arrow 17 and the free ends of the reset springs 15 are received in the seating surfaces 16 to form an assembly. To prevent the armature from becoming removed from the assembly, a protective cap 18 is assembled on the assembly by moving the cap in the downward direction of the arrow. The cap 18 acts to hold the armature in the assembled position but allows movement between the neutral or disengaged position and the energized position with the ends 11*a* and 11*b* energizing the pole pieces. It should be noted that the restoring force of the recess springs 15 will urge the armature outwardly against the cap.

As a result of different biasing of the reset springs 15, it would be conceivable that in a neutral or natural position, the armature presses with one end 11*a* or 11*b* against the corresponding pole pieces 5*a* or 5*b* and executes a pivoted motion around the appertaining armature end when switching occurs. As a rule, however, all of the reset springs 15 will be identically prestressed so that the armature executes translational switch motion in the direction of the arrow 17 which is perpendicular to the coil axis when switching occurs.

The base body 1 also has a space 19 which is opposite the recess 4*a* for receiving a getter 20. The relay can be tightly enclosed by a film 21 (FIG. 2) which is slipped over the terminal pins of the contact such as 6 and is welded or bonded to on lower edge 18*a* of the protective cap 18. Subsequent to securing the film 21 on the edges 18*a*, a casting compound 23 can be introduced syphon-like through an opening 22 (FIG. 1) in a corner of the casing 18. The material 23 (FIG. 2) will seal or close the opening 22 when the compound hardens.

As mentioned, the terminal pins such as 6*a*, 7*a*, 9*a* and 10*a* project downwardly from the relay housing in a row. The relay can then be put in place on a printed circuit board as a narrow component. When needed, the terminal pins 6*a*, 7*a*, 9*a* and 10*a*, which extend in a row, can be bent 90° around the common axis so that the relay will lie flat on the printed circuit board.

The relay 100 as illustrated in FIGS. 1 and 2 can be made with various stages of manufacturing. In the first steps, a core 5, the contact elements 6 and 7 as well as with the core terminal pins 9 and 10 are stamped from a common blank with all of the parts remaining connected to the strip or temporary web portion 24 of the blank. As illustrated, the terminal pins 6*a* and 7*a* are either directly connected to the strip 24 as shown by the portion 7*a*' or when the pins 9 and 10 are present, the pin, such as 6*a*, is connected to pin 9*a* and the point 9*b* is connected to web 24. A holding web such as 25 extends to and holds the core 5 to the strip or web portion 24. All of these parts are then encapsulated to form the base body 1 by being placed in a mold and having the insulating material molded or extruded thereon. The terminal pins are subsequently cut free from the pins 9 and 10 or the strip 24 and the holding web 25 is severed adjacent the body 1. A coil or winding 2 is then applied to the base body 1 and the ends 2*a* and 2*b* of the winding are then wound or wrapped onto the respective winding support points 9*b* and 10*b*. After applying the ends 2*a* and 2*b* to the support portions 9*b* and 10*b*, the coil terminal pins can be bent into the coil as illustrated by the pin 10 so that the connecting pins 9*a* and 10*a* project from the underside of the relay parallel to and in the same plane on the connecting pins 6*a* and 7*a* of the contact elements.

An armature 11 with the sheet 12 cut to form the contact portion 14 and the reset spring portion 15 is subsequently inserted and then the relay can be closed with the protective cap 18. Subsequently, the film 21 is secured to the edges 18*a* of the cap 18 and the material 23 is inserted into the base as mentioned hereinbefore.

Although various minor modifications may be suggested by those versed in the art, it should be understood that we wish to embody within the scope of the patent granted hereon, all such modifications as reasonably and properly come within the scope of our contribution to the art.

We claim:

1. In an electromagnetic miniature relay having a base body containing a flat core being disposed inside of an excitation coil with ends of the core extending from both ends of the coil to form a pole piece at each end of the core for an armature having ends which armature is disposed next to the coil and is pressed against a spring arrangement to have the ends engage both pole pieces when the coil is energized, the improvements comprising said core being embedded in the base body, at least one stationary contact with a terminal pin being embedded in the base body adjacent each end of the coil and in the area of the armature ends, and a contact spring member being connected to a central portion of the armature and having contact portions with a length along the length of the armature to extend beyond the ends of the armature to form movable contacts to overlie the stationary contacts, said movable contacts being moved with the armature so that when the coil is denergized, the ends of the armature form air gaps with each of the pole pieces and the movable contacts are spaced from the adjacent stationary contact elements and when the coil is energized the armature moves against the spring arrangement with the armature ends moving into contact with the pole pieces and the movable contacts which are formed by the ends of the contact portions engage the two stationary contacts to form an electric contact therebetween.

2. In an electromagnetic miniature relay according to claim 1, wherein the core is a planar sheet and wherein the armature is a sheet metal armature having bent portions to form offset ends which extend toward the pole pieces.

3. In an electromagnetic miniature relay according to claim 1, wherein the spring arrangement includes at least one reset spring of a leaf-type structure secured to the central section of the armature and having a free end engaged in a seating surface formed in the base body adjacent one of the stationary contacts.

4. In an electromagnetic miniature relay according to claim 3, wherein the reset spring is disposed on each side of the contact portion of the contact spring.

5. In an electromagnetic miniature relay according to claim 4, wherein said reset springs and contact portions of the contact spring are formed in a single one-piece member with each reset spring being spaced from the contact portion by a longitudinally extending slot.

6. In an electromagnetic miniature relay according to claim 3, which includes means preventing the armature from being biased beyond a given point by the reset spring, said means comprising a housing cap receiving the relay.

7. In an electromagnetic miniature relay according to claim 1, wherein only the pole pieces of the core and the contacting surfaces of each of the stationary contact elements are exposed.

8. In an electromagnetic miniature relay according to claim 7, wherein coil-connecting elements are also embedded in said base body, each of said coil-connecting elements having terminal pins extending in the same plane as the terminal pins of the stationary contacts from one side of the base body.

9. A method of forming a relay having a base body containing a flat core being disposed within an excitation coil and having ends of the flat core extending beyond the ends of the coil to form pole pieces for an armature, said body having a stationary contact with a terminal pin at each end adjacent the pole piece, said armature having a flat contact spring arrangement secured to the center of the armature with the contact portions engaging the stationary contacts when the coil is energized to cause the armature to move against a biasing means and into contact with the each of the pole pieces, said method comprises the steps of providing a flat core and stationary contacts, embedding the core and stationary contacts in the base body, assembling a coil on the body, providing an armature having the contact spring secured to center portion of the body, assembling the armature on the base body with the ends engaging the pole pieces to form an assembly and subsequently placing a protective cap on the assembly to maintain the armature in its position.

10. In a method of manufacturing a relay according to claim 9, wherein the step of providing a flat core and stationary contacts comprises stamping of the flat core and stationary contacts from a common sheet metal blank with a connecting web holding the contacts and core in the desired relationship, said step of embedding the core and stationary contacts in a base body including placing the core and stationary contacts in a mold utilizing the connecting web to hold them in the desired position while encapsulating the flat core and stationary contacts with the material of the base body and then subsequently removing the connecting web.

11. In a method of manufacturing a relay according to claim 10, wherein the step of providing the flat core and stationary contacts also includes forming coil terminal pins in the blank sheet with the pins being connected to the connecting web so that the step of positioning the core and stationary contacts in the mold also positions the coil terminal pins for encapsulation in the base body.

* * * * *